US005246356A

United States Patent [19]

Scarfone

[11] Patent Number: 5,246,356

[45] Date of Patent: Sep. 21, 1993

[54] SOUND ABATEMENT IN ROTARY COMPRESSORS

[75] Inventor: Tommaso F. Scarfone, Bayonne, N.J.

[73] Assignee: Carrier Corporation, Syracuse, N.Y.

[21] Appl. No.: 988,499

[22] Filed: Dec. 10, 1992

[51] Int. Cl.[5] ..... F04C 2/00

[52] U.S. Cl. ..... 418/63; 418/270; 29/888.02; 415/119

[58] Field of Search ..... 418/63, 270; 29/888.02, 29/447; 415/215.1, 119; 417/423.14

[56] References Cited

U.S. PATENT DOCUMENTS 4,790,733 12/1988 Vaccaro ..... 418/63

FOREIGN PATENT DOCUMENTS 0103985 6/1984 Japan ..... 418/63

*Primary Examiner*—Richard A. Bertsch
*Assistant Examiner*—Charles G. Freay

[57] ABSTRACT

The crankcase or cylinder body of a rotary compressor is secured in a shell by a shrink fit thereby providing intimate contact over its entire circumference. To maintain the proper positioning of the crankcase during the shrink fitting process, the outer surface of the crankcase defines a portion of a sphere, specifically the equatorial portion. As a result the spherical surface provides a stable contact surface over a range of positions of the crankcase and the intimate contact changes the frequencies of response of the shell.

3 Claims, 1 Drawing Sheet

SOUND ABATEMENT IN ROTARY COMPRESSORS

BACKGROUND OF THE INVENTION

In a high side fixed vane or rolling piston rotary compressor, a vane reciprocates in a vane slot formed in the cylinder as the vane acts as a cam follower relative to the eccentric piston. The vane divides a crescent shaped chamber formed by the piston and cylinder into a suction chamber and a discharge chamber. Hot, compressed gas passes from the discharge chamber, through a muffler into the interior of the shell or casing in a pulsed flow. The pulsed flow tends to cause vibrations. Conventionally the crankcase is placed in the shell with a clearance and then plug welded at several discrete points. As a result, the shell has relatively large areas with strong sound radiating characteristics acted on by the pressure pulsations of the pulsed flow.

SUMMARY OF THE INVENTION

The crankcase, or pump assembly, is secured in the shell of a rotary compressor by a shrink fit. This puts the shell into intimate contact with the crankcase for its entire circumference and stresses the shell in creating the shrink fit. As a result, the shell is stiffened and damped by the intimate contact which makes the shell less prone to vibration. Additionally, by increasing the area/location of intimate contact, the dimensions of the portions of the shell prone to sound radiation are changed as well as the frequencies of response.

It is an object of this invention to change the vibration and sound radiating characteristics of the shell of a hermetic compressor.

It is another object of this invention to eliminate the gap between the crankcase and the shell.

It is a further object of this invention to locate the crankcase of a rotary compressor in a shell by a shrink fit while allowing the axis of the crankcase and stator to be coincident. These objects, and others as will become apparent hereinafter, are accomplished by the present invention.

Basically, the crankcase or cylinder body of the pump assembly is provided with a circumferential surface which is a portion of a sphere. The shell is shrunk fit to the spherical surface which results in an intimate contact with a circumferential groove being effectively formed in the shell as it conforms to the spherical surface. Additionally, because the spherical surface is the location of contact/attachment, the crankcase or cylinder body can be oriented relative to its bore, etc. without influencing the shrink fit attachment.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
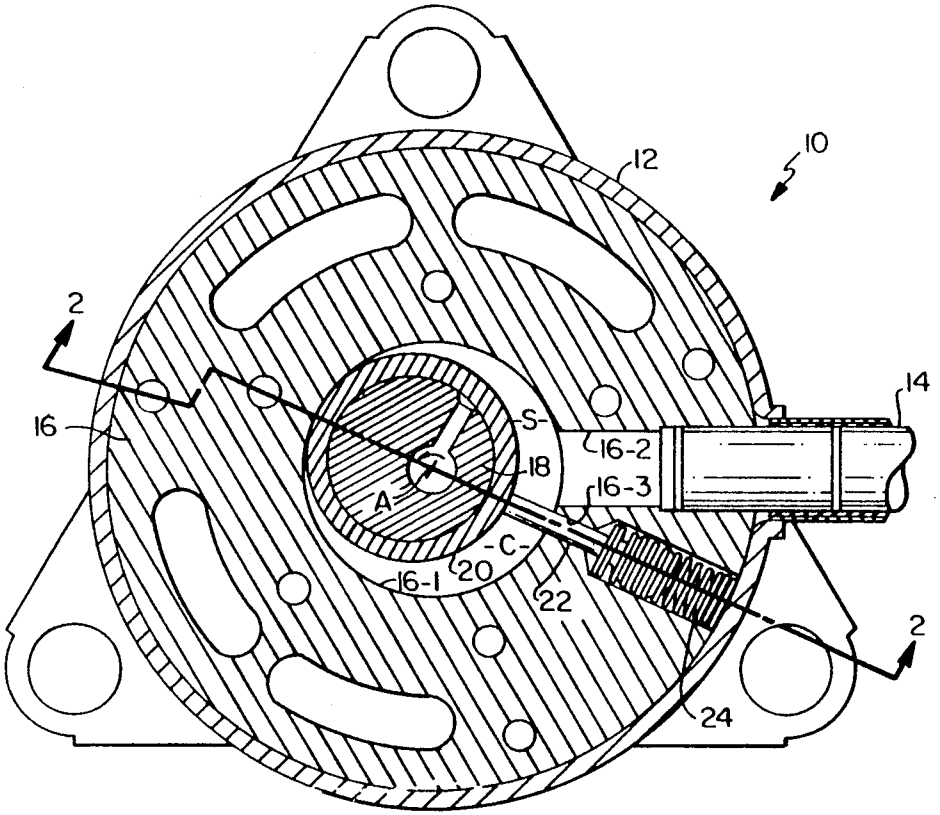
FIG. 1 is a sectional view through the crankcase of a rolling piston compressor.

In FIG. 1, the numeral 10 generally designates a fixed vane or rolling piston compressor having a shell or casing 12 and a suction line 14. Crankcase 16 is secured in shell 12 and has axially extending cylindrical piston bore 16-1 formed therein. Radial bore 16-2 is formed in crankcase 16 and provides fluid communication between suction line 14 and piston bore 16-1. Piston 20 is located on the eccentric of the eccentric shaft 18 and rolls along the wall of cylindrical piston bore 16-1 and coacts therewith to define a crescent shaped chamber which, as illustrated, is divided by vane 22 into suction chamber, S, and compression chamber, C.

Axis A—A which appears in FIG. 1 as point A is the centerline for shell 12 and for bore 16-1 as well as the axis of rotation for eccentric shaft 18. Spring 24 biases vane 22 into contact with piston 20. In operation, vane 22 remains in contact with piston 20 while piston 20 rolls around the wall of bore 16-1. The line of contact between piston 20 and the wall of bore 16-1 will reach vane 22, whose slot 16-3 opens into bore 16-1, at the completion of the discharge stroke. The hot, compressed gas discharged, in a pulsed flow, from compression chamber C serially passes through a discharge port, muffler, interior of shell 12 and out a discharge line (not illustrated), as is conventional for a high side rotary compressor. The pulsed flow tends to cause vibration of, and sound radiation from, the shell 12.

The present invention reduces the vibrations and sound radiation associated with the pulsed discharge by securing the crankcase 16 in shell 12 by a shrink fit which results in an intimate contact over 360°, the full circumference, with a resultant stiffening of the shell 12 thereby changing the frequency response. The importance of the spherical surface 16-4 is that it presents a contact surface that is stable over a range of orientations of axis A—A. In contrast if surface 16-4 was part of cylinder then the shell 12, surface 16-4, and bore 16-1 must all be concentric and coincide with A—A. So, if shell 12 is shrunk fit onto a cylindrical surface then the stress will tend to align the cylindrical surface and the interior of the shell which can result in a non uniform air gap between the rotor and stator and/or a misalignment of the piston and eccentric shaft. Crankcase 16 will be located on a fixture (not illustrated) or may be part of an assembled pump cartridge.

Figure 2:
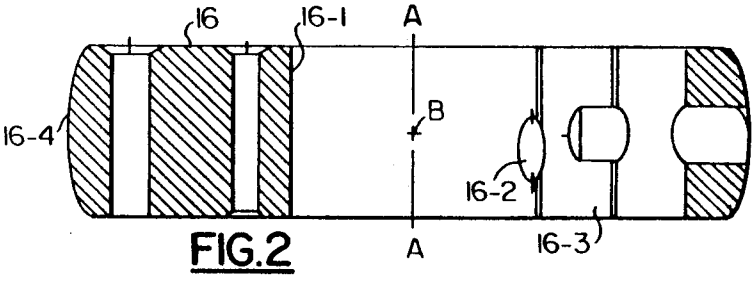
FIG. 2 is a sectional view along line 2—2 of FIG. 1 but only showing the crankcase.
Figure 3:
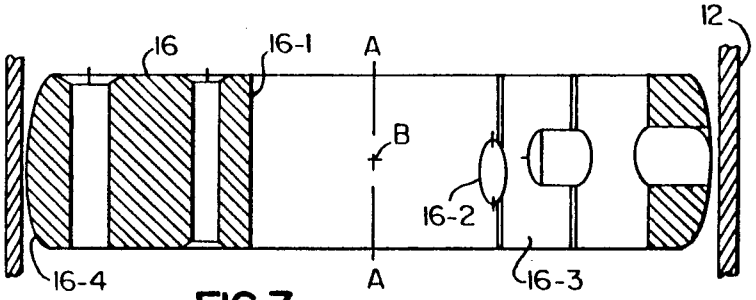
FIG. 3 is a sectional view corresponding to FIG. 2 showing an intermediate stage of the shrink fit.
Figure 4:
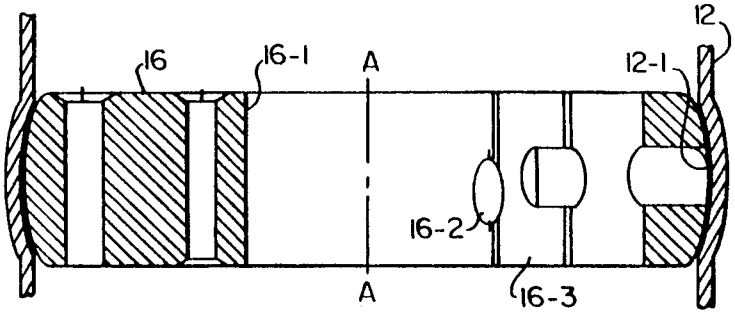
FIG. 4 is a sectional view corresponding to FIGS. 2 and 3 showing the shrink fit.

Referring initially to FIG. 2, it will be noted that, rather than having a conventional cylindrical outer surface, crankcase 16, alone or as part of a pump assembly, has an outer surface 16-4 which is a portion of a sphere whose center, B, is on center line A—A at, or near, a midpoint of crankcase 16. Referring now to FIG. 3, shell 12, which has an interference fit with said crankcase at ambient temperature, has been heated such that crankcase 16 can be placed in shell 12 or shell 12 can be placed over crankcase 16 with clearance. Additionally, crankcase 16 can be cooled to increase the clearance. Because surface 16-4 is spherical, the movement of axis A—A over a significant angular displacement will still present a spherical surface to the interior of shell 12. As a result, crankcase 16, or more specifically bore 16-1 and axis A—A can be properly located by the fixture within the heated shell 16 without concern for the accommodating of surface 16-4 to the surface of the interior of shell 12. Referring now to FIG. 4, temperature equalization will cause shell 12 to shrink.

Because of the spherical surface 16-4, the amount of shrinkage possible is not uniform but there is no force produced tending to reorient surface 16-4 to the inner surface of shell 12. Accordingly, the shell 12 conforms to the surface 16-4 which has the effect of locating an annular groove 12-1 in the interior surface of shell 12.

As stated above, the axis A—A can be located over a significant range, as compared to manufacturing tolerances, without interfering with the coaction of the shell 12 with crankcase 16 during the shrink fit. Stated otherwise, the shrink fit does not reposition the crankcase 16 in seeking to balance the forces as where the surface of the crankcase does not match that of the shell due to different or nonuniform slope, etc. As a result, the crankcase 16 can be shrunk fit into the shell 12 as part of an assembly, or a fixture can locate the crankcase with integrity for locating the motor for air gap control.

Although a preferred embodiment of the present invention has been illustrated and described, other changes will occur to those skilled in the art. For example, although surface 16-4 is described as being a portion of a sphere, the rounded surface 16-4 rather than the spherical segment is important. So, as viewed in FIG. 1, crankcase 16 could, for example, be elliptical within the teachings of the present invention. Shell 12 would also have to be elliptical. It is therefore intended that the scope of the present invention is to be limited only by the scope of the appended claims.

What is claimed is:

1. A high side hermetic compressor means including a shell having a wall, and a crankcase wherein:

said crankcase has a circumferential surface which forms a portion of a generally spherical surface;

said shell being shrunk fit onto said crankcase such that a circumferential groove is formed in said wall to accommodate said generally spherical surface whereby intimate contact occurs between said wall and said crankcase over 360° to thereby secure said crankcase in place and to change vibrational and sound radiating characteristics of said shell.

2. A method of securing a crankcase within a shell comprising the steps of:

providing a crankcase having a circumferential surface which forms a portion of a generally spherical surface;

providing a shell with a wall having an interference fit with said crankcase at ambient temperature;

creating a differential temperature between said crankcase and said shell whereby said interference fit is changed to a clearance condition;

locating said crankcase within said shell under said clearance condition; and permitting temperatures of said crankcase and shell to equalize such that said shell is shrunk fit onto said crankcase such that a circumferential groove is formed in said wall to accommodate said generally spherical surface whereby intimate contact occurs between said wall and said crankcase over 360° to thereby secure said crankcase in place and to change vibrational and sound radiating characteristics of said shell.

3. The method of claim 2 wherein said step of locating said crankcase within said shell includes properly positioning said crankcase within said shell and said proper position is maintained during temperature equalization which initially includes contact between said shell and a equatorial circumference of said spherical surface of said crankcase.

* * * * *